US009574486B2

(12) United States Patent
Lee et al.

(10) Patent No.: US 9,574,486 B2
(45) Date of Patent: Feb. 21, 2017

(54) CONTROL SYSTEM OF ELECTRICAL THERMOSTAT AND THE SYSTEM THEREOF

(71) Applicants: Hyundai Motor Company, Seoul (KR); Kia Motors Corporation, Seoul (KR); Inzicontrols Co., Ltd., Siheung-si (KR)

(72) Inventors: Philgi Lee, Suwon-si (KR); Gyuhwan Kim, Suwon-si (KR); Jae Suk Park, Suwon-si (KR); Yong Jeong Kim, Ansan-si (KR)

(73) Assignees: Hyundai Motor Company, Seoul (KR); Kia Motors Corporation, Seoul (KR); Inzicontrols Co., Ltd., Siheung-si (KR)

( * ) Notice: Subject to any disclaimer, the term of this patent is extended or adjusted under 35 U.S.C. 154(b) by 929 days.

(21) Appl. No.: 13/730,005

(22) Filed: Dec. 28, 2012

(65) Prior Publication Data

US 2014/0103124 A1 Apr. 17, 2014

(30) Foreign Application Priority Data

Oct. 17, 2012 (KR) ..... 10-2012-0115640

(51) Int. Cl.
*F01P 7/16* (2006.01)

(52) U.S. Cl.
CPC ..... *F01P 7/167* (2013.01); *F01P 2070/04* (2013.01)

(58) Field of Classification Search
CPC ..... F01P 7/167; F01P 2070/04; F01P 11/16; G05D 23/022; F01M 5/007
See application file for complete search history.

(56) References Cited

U.S. PATENT DOCUMENTS 5,582,138 A * 12/1996 Ziolek ..... F01P 7/167 123/41.1
2003/0098077 A1* 5/2003 McLane ..... B60H 1/00485 137/625.47
2004/0074894 A1* 4/2004 Santanam ..... 219/494
2004/0238652 A1* 12/2004 Takei et al. ..... 236/34.5
2007/0028862 A1* 2/2007 Braun et al. ..... 123/41.1
2007/0065694 A1* 3/2007 Maier ..... H01M 8/04037 429/430

(Continued)

FOREIGN PATENT DOCUMENTS

CN 102705056 (A) 10/2012

*Primary Examiner* — Allana Lewin Bidder
*Assistant Examiner* — Kun Kai Ma
(74) *Attorney, Agent, or Firm* — Morgan, Lewis & Bockius LLP

(57) ABSTRACT

A control method of an electrical thermostat that includes an operating heater heating wax so as to operate an operating valve that may be disposed to close a coolant passage according to an exemplary embodiment of may include detecting a coolant temperature of coolant circulating a coolant passage, determining whether the coolant temperature may be included in a predetermined heating temperature range, performing a coolant heating mode by supplying a predetermined level of power to the operating heater for a predetermined time, if the coolant temperature may be within the heating temperature range, and stopping the coolant heating mode in a condition that the operating valve may be closed.

14 Claims, 4 Drawing Sheets

(56) References Cited

U.S. PATENT DOCUMENTS

| | | | | |
|---|---|---|---|---|
| 2008/0223317 | A1* | 9/2008 | Shintani | F01P 3/12<br>123/41.05 |
| 2008/0300774 | A1* | 12/2008 | Wakahara | 701/113 |
| 2009/0301408 | A1* | 12/2009 | Mounetou | F01P 7/167<br>123/41.1 |
| 2011/0214626 | A1* | 9/2011 | Watanabe | F01P 7/14<br>123/41.1 |
| 2012/0111956 | A1* | 5/2012 | Kinomura et al. | 236/93 R |
| 2012/0138696 | A1 | 6/2012 | Ryu | |
| 2013/0255605 | A1* | 10/2013 | Jentz | F01P 11/16<br>123/41.15 |
| 2014/0034741 | A1* | 2/2014 | Schwartz et al. | 236/46 R |

* cited by examiner

Characteristics graph

CONTROL SYSTEM OF ELECTRICAL THERMOSTAT AND THE SYSTEM THEREOF

CROSS-REFERENCE TO RELATED APPLICATION

The present application claims priority to Korean Patent Application No. 10-2012-0115640 filed on Oct. 17, 2012, the entire contents of which is incorporated herein for all purposes by this reference.

BACKGROUND OF THE INVENTION

Field of the Invention

The present invention relates to a control method of an electrical thermostat and the system thereof that changes a passage of a coolant depending on the temperature of the coolant and actively controls the coolant temperature to prevent overheating thereof.

Description of Related Art

A thermostat for a vehicle is disposed between an engine and a radiator, is automatically opened/closed by the temperature variation of coolant to adjust the flow rate of the coolant, and therefore the temperature of the coolant is controlled in a predetermined range.

A mechanical thermostat expands wax depending on the temperature of the coolant, and the expanding force of the wax makes a piston move the valve of the thermostat.

The mechanical thermostat is operated in a predetermined opening/closing temperature of the coolant to open/close the valve only in a predetermined temperature condition, and therefore the mechanical thermostat does not actively move against changes of the driving circumstances of the vehicle.

Accordingly, an electrical thermostat has been introduced to complements the drawback of the mechanical thermostat, and the electrical thermostat is operated to sustain the coolant temperature in an optimized range.

The electrical thermostat actively controls the coolant temperature of the engine according to the driving circumstances such as the load level of the vehicle to sustain the optimized coolant temperature, and the electrical thermostat can improve fuel consumption efficiency and reduce exhaust gas.

A drive portion that is a temperature sensitive type and is electrically controlled has been applied to open or close the valve of a thermostat, and the drive portion includes wax, semi-fluid, a rubber piston, a back-up plate, and a main piston.

Here, a coolant temperature is low before an engine is started, and therefore fuel consumption and harmful exhaust gas can be increased by the low temperature coolant. Accordingly, the arts for quickly raising the coolant temperature have been researched.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a control method of an electrical thermostat and the system thereof having advantages of quickly raising the coolant temperature after an engine is started.

In an aspect of the present invention, a control method of an electrical thermostat that may include an operating heater configured to heat wax so as to operate an operating valve that is disposed to close a coolant passage, may include detecting a coolant temperature of coolant flowing along the coolant passage, determining whether the coolant temperature is may include d in a predetermined heating temperature range, performing a coolant heating mode by supplying a predetermined level of power to the operating heater for a predetermined time when the coolant temperature is within the predetermined heating temperature range, and stopping the coolant heating mode when the operating valve is closed.

The predetermined heating temperature range is set to be lower than an operating minimum temperature.

The control method of the electrical thermostat may further include selecting the predetermined level of the power and the predetermined time that are supplied to the operating heater from a map data according to the coolant temperature that is may include d in the heating temperature range, and supplying the operating heater with the predetermined level of the power for the predetermined time that is selected from the map data.

The predetermined level is a PWM duty and the PWM duty is selected from 0 to 100% range.

The control method of the electrical thermostat may further include determining whether the coolant temperature is higher than the operating minimum temperature for operating the operating valve, and performing a valve operating control for opening the operating valve when the coolant temperature is higher than the operating minimum temperature.

The control method of the electrical thermostat may further include increasing a PWM duty when the coolant temperature is higher than a target temperature.

The control method of the electrical thermostat may further include setting the PWM duty to 100% when it is determined that an absolute value between the target temperature and the coolant temperature is larger than an upper allowance value.

The control method of the electrical thermostat may further include decreasing a PWM duty when the coolant temperature is lower than a target temperature.

The control method of the electrical thermostat may further include setting the PWM duty to 0% when it is determined that an absolute value between the target temperature and the coolant temperature is lower than a lower allowance value.

The coolant heating mode is stopped before the operating valve is opened.

In another aspect of the present invention, a control system of an electrical thermostat that may include an operating heater configured to heat wax so as to operate an operating valve that is disposed to close a coolant passage, may include a temperature detector that detects a coolant temperature of coolant flowing along the coolant passage, a power supply portion that supplies the operating heater with power, and a control portion that controls the power that is supplied to the operating heater from the power supply portion by using a temperature signal that is transferred from the temperature detector, wherein the control portion determines whether the coolant temperature is within a predetermined heating temperature range, controls the power supply portion to supply the operating heater with a predetermined level of power for a predetermined time when the coolant temperature is within a heating temperature range, and heats the coolant when the operating valve is closed.

The heating temperature range is set to be lower an operating minimum temperature.

The control portion selects the predetermined level of power and the predetermined time that are supplied to the operating heater from a map data according to the coolant temperature that is may include d in the heating temperature range and supplies the operating heater with the predetermined level of power for the predetermined time that is selected from the map data.

The predetermined level is a PWM duty and the PWM duty is selected from 0 to 100% range.

The control portion determines whether the coolant temperature is higher than the operating minimum temperature for operating the operating valve, and performs a valve operating control for opening the operating valve when the coolant temperature is higher than the operating minimum temperature.

The control portion increases a PWM duty when the coolant temperature is higher than a target temperature.

The control portion sets the PWM duty to 100% when it is determined that an absolute value between the target temperature and the coolant temperature is larger than an upper allowance value.

The control portion decreases a PWM duty when the coolant temperature is lower than a target temperature.

The control portion sets the PWM duty to 0% when it is determined that an absolute value between the target temperature and the coolant temperature is lower than a lower allowance value.

The control portion stops the coolant heating mode before the operating valve is opened.

The control method of an electrical thermostat and the system thereof according to an exemplary embodiment of the present invention supplies an operating heater with electric power to raise the coolant temperature in a condition that the operating valve is maintained to be closed, if the coolant temperature is included in a heating temperature range.

Further, because an operating heater of a thermostat is used without a separate heating device, the cost is saved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
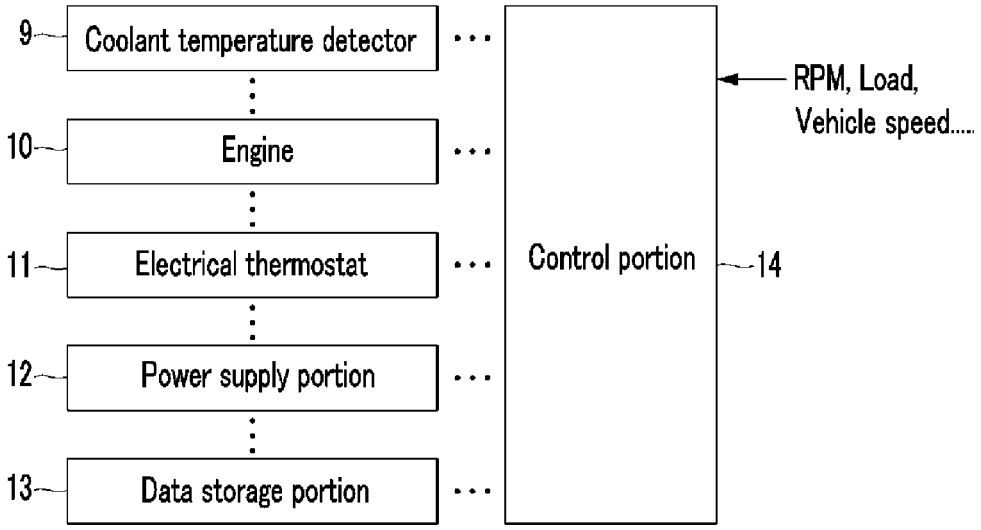
FIG. 1 is a schematic diagram of a system having an electrical thermostat according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a schematic diagram of a system having an electrical thermostat according to an exemplary embodiment of the present invention.

Referring to FIG. 1, a system having an electrical thermostat includes a coolant temperature detector 9, an engine 10, an electrical thermostat 11, a power supply portion 12, a data storage portion 13, and a control portion 14.

The coolant temperature detector 9 detects the temperature of the coolant circulating the engine 10, and transfers the detected temperature to the control portion 14. And, the control portion 14 detects driving information such as RPM, load, and vehicle speed of the engine 10.

The control portion 14 selects data from the data storage portion 13 according to the driving information and the coolant temperature and controls the power supply portion 12 depending on the selected data to actively control the electrical thermostat 11.

The control portion 14 controls the power that is supplied to the operating heater (105 of FIG. 3) of the electrical thermostat 11 through the power supply portion 12. Accordingly, the coolant of the engine is circulated to the radiator at an appropriate time by actively opening or closing the operating valve 200 of the electrical thermostat 11.

if it is determined that the temperature of the coolant circulating the engine 10 is within a heating temperature range that is a predetermined low value, the control portion 14 operates the operating heater (105 of FIG. 3) to perform a coolant heating mode in an exemplary embodiment of the present invention.

The coolant heating mode is characterized in that the power is supplied to the operating heater 105 and the operating valve (200 of FIG. 3) maintains its closed condition. If the operating valve 200 is opened by the heater 105, the temperature of the coolant is not raised, because the coolant is cooled by the radiator (150 of FIG. 3).

Further, the heating temperature range that the coolant heating mode is performed can range from −40 to 40 Celsius degrees, and the heating temperature range can be varied depending on the design specification.

The power that is supplied to the operating heater 105 has a PWM duty type and it is controlled in a level ranging from 0 to 100%.

A vehicle is tested in advance, wherein the power level and power supply time that are supplied to the operating heater 105 are predetermined depending on the coolant temperature and the driving information of the tested vehicle, and the predetermined power level and power supply time are stored in the data storage portion 13 as a map data type.

The control portion 14 detects the coolant temperature and the driving information, selects the data from the map data that is stored in the data storage portion 13 depending on the detected information, and controls the level and the supply time of the power that is supplied to the operating heater 105 based on the selected data.

The coolant heating mode is performed in a condition that the operating valve 200 is closed so as to effectively raise the temperature of the coolant in an exemplary embodiment of the present invention.

Figure 2:
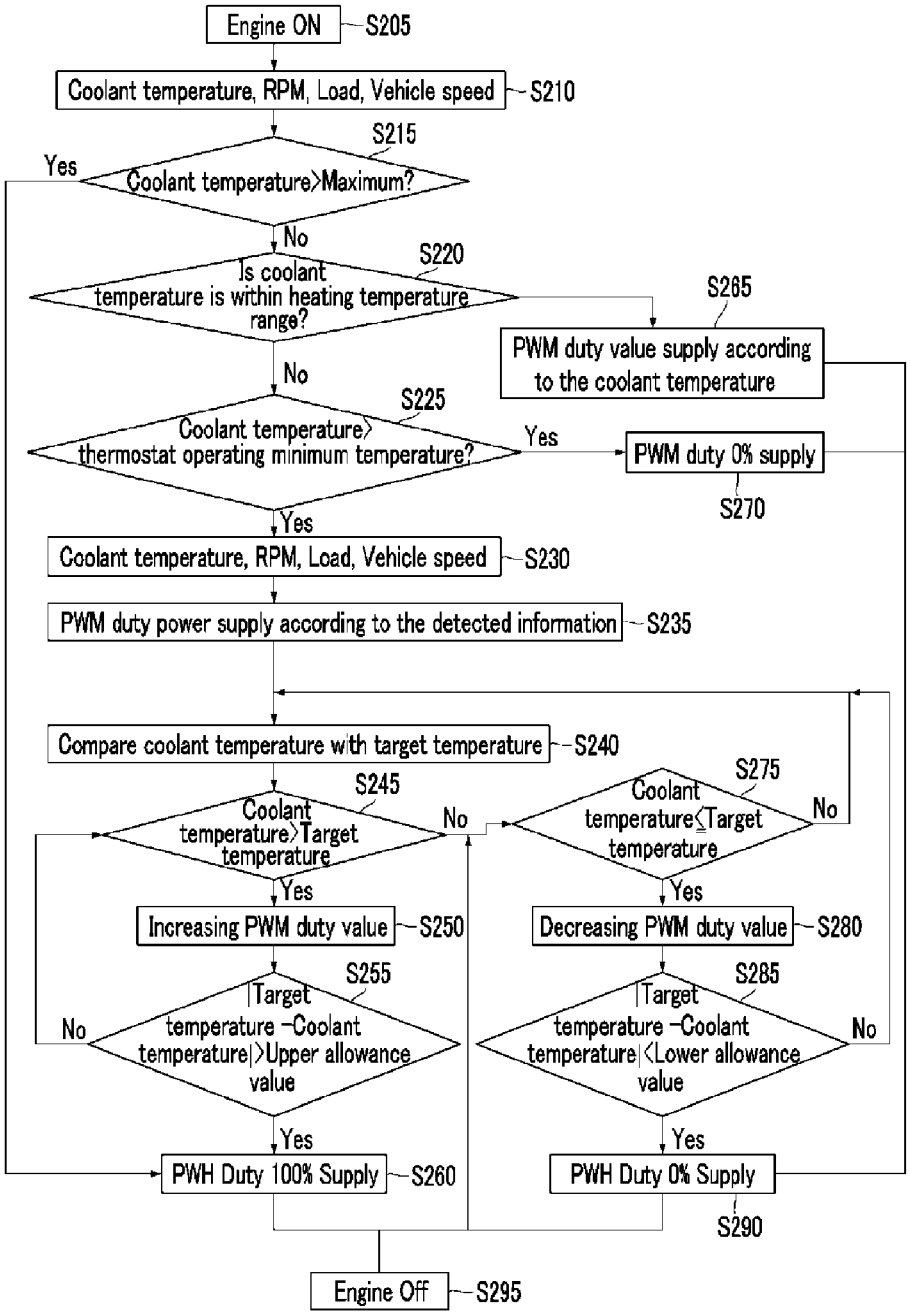
FIG. 2 is a flowchart showing a control method of an electrical thermostat according to an exemplary embodiment of the present invention.

FIG. 2 is a flowchart showing a control method of an electrical thermostat according to an exemplary embodiment of the present invention.

Referring to FIG. 2, a starting of an engine is detected in a S205. A coolant temperature, a RPM, a load, and a vehicle speed are detected in a S210.

It is determined whether the coolant temperature is larger than a predetermined max value in a S215. If the coolant temperature is larger than that, a S260 is performed, wherein the PWM duty that is supplied to the operating heater 105 becomes 100%. If the coolant temperature is less than that, a S220 is performed. The max value of the coolant temperature can be 120 Celsius degrees.

It is determined whether the coolant temperature is in the heating temperature range in a S220. The heating temperature range can be a value that is selected from −40 to +40 Celsius degrees. Here, the heating temperature range is set to be lower than an operating minimum temperature (for example, 60 Celsius degrees) that the operating valve 200 starts to be operated.

If the coolant temperature is not within the heating temperature range, it is determined whether the coolant temperature is larger than the operating minimum temperature of the electric thermostat 11 in a S225. The operating minimum temperature can be +60 Celsius degrees.

More particularly, if it is determined that the coolant temperature is less than 40 Celsius degrees (heating temperature range), the coolant heating mode is performed in the S265, and if it is determined that the coolant temperature is larger than 60 Celsius degrees (operating min temperature), the S230 is performed, and if it is determined that the coolant temperature ranges from 40 to 60 Celsius degrees (no operating range), the S270 is performed.

The coolant temperature, the RPM, and the load of an engine, and the vehicle speed are detected in the S230, and the PWM duty that is supplied to the operating heater 105 is controlled according to the detected information.

A real coolant temperature is compared to a target temperature in a S240, it is determined whether the coolant temperature is higher than the target temperature in a S245, and if it is higher that, the PWM duty value % that is supplied to the heater 105 is raised in a S250.

It is determined whether the absolute value between the target temperature and the coolant temperature is larger than an upper side allowance value in a S255.

The upper side allowance value is hysteresis value, if the target temperature value ranges within 100±5, the upper side allowance value is 5 and a lower side allowance value is 5. The upper side allowance value and the lower side allowance value can be varied according to the design specification.

If it is determined that the coolant temperature is less than the target temperature in a S275, the PWM duty value that is supplied to the operating heater 105 is decreased in a S280. And, it is determined whether the difference between the target temperature and the coolant temperature is less than the lower side allowance value in a S285.

If it is NO in the S255 and the S285, a S245 and a S275 are respectively performed, if it is Yes in the S255 and the S285, a S260 and a S290 are respectively performed.

The current level that is supplied to the operating heater 105 is controlled in a S270 in an exemplary embodiment of the present invention. As described above, if the coolant temperature is within the heating temperature range, the level and the supply time of the PWM duty that is supplied to the operating heater are selected from a map data.

That is, if the coolant temperature is within the heating temperature range, a predetermined level of power is supplied to the operating heater 105 for a predetermined time such that the coolant temperature is quickly raised.

The predetermined time and the predetermined level are made from the test result to be arranged in a map table, and the map table is memorized in the data storage portion 13.

Figure 3:
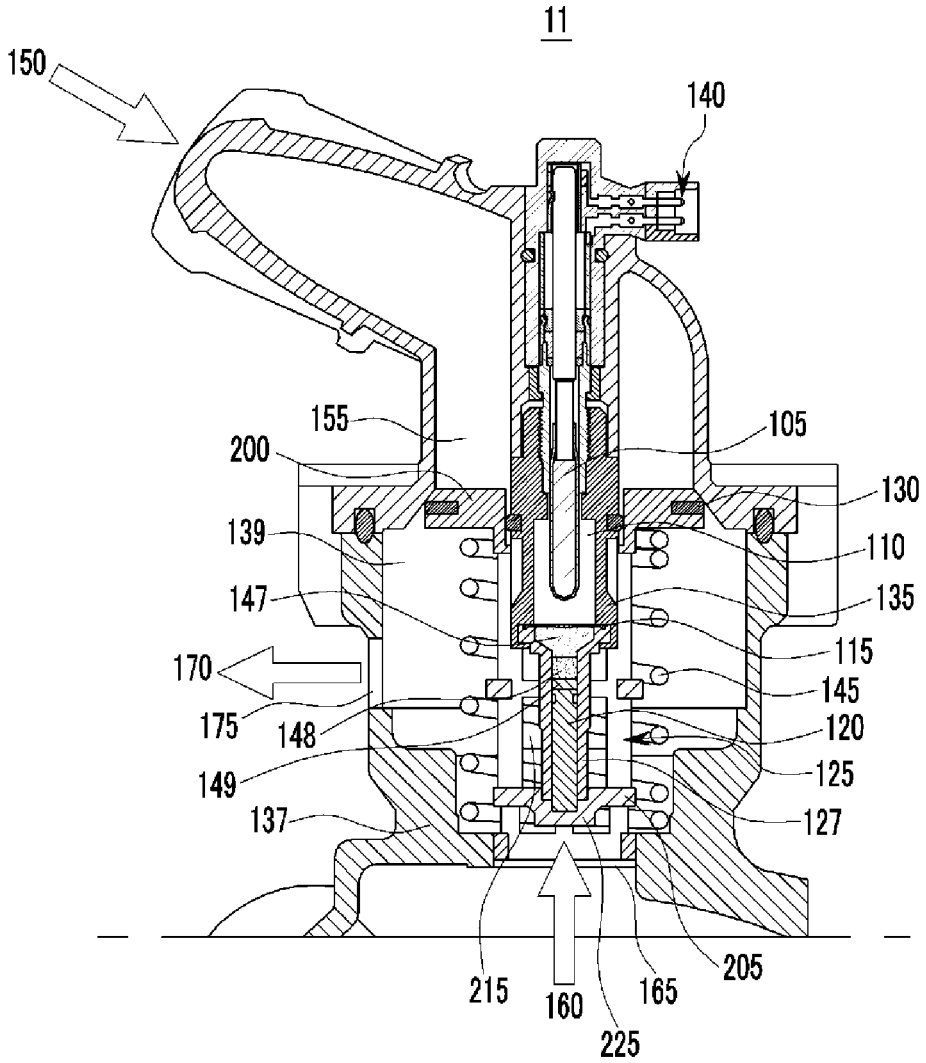
FIG. 3 is a partial cross-sectional view of an electrical thermostat that is disposed on a coolant line of an engine according to an exemplary embodiment of the present invention.

FIG. 3 is a partial cross-sectional view of an electrical thermostat that is disposed on a coolant line of an engine according to an exemplary embodiment of the present invention.

Referring to FIG. 1, an engine includes a radiator 150, a coolant outlet 160 of an engine, a coolant inlet 170 of an engine, and a thermostat 100.

The thermostat 100 includes a thermostat case 137, and a first passage 155 is formed to be connected to the radiator 150, a second passage 165 is formed to be connected to the coolant outlet 160, and a third passage 175 is connected to the coolant inlet 170 in the thermostat case 137.

A coolant pump in an exemplary embodiment of the present invention is disposed between the third passage 175 and the coolant inlet 170 to circulate coolant from the thermostat 100 to the engine.

As shown in drawings, the first passage 155 is formed at an upper side, the second passage 165 is formed at a lower side, and the third passage 175 is formed between the first and second passages 155 and 165.

A joining space 139 is formed in the thermostat case 137 to be connected to the first passage 155, the second passage 165, and the third passage 175, and a valve body 125 is disposed in the joining space 139.

A first valve 200 is integrally formed at an upper end portion of the valve body 125 to selectively close the first passage 155, and a second valve 205 is integrally formed at a lower end portion of the valve body 125 to selectively close the second passage 165. Further, a valve O-ring 130 is mounted along an exterior circumference of the first valve 200 to contact the interior circumference of the first passage 155.

A main spring 145 is disposed inside the thermostat case 137, and an upper end portion of the main spring 145 elastically supports the lower end portion of the first valve 200 in an upper direction, and a lower end portion of the main spring 145 is supported by an inner side of the thermostat case 137.

The main spring 145 has a coil spring structure, and the valve body is inserted into the coil of the main spring 145 except the first valve 200 and the part that that is inserted into the second passage 165.

Further, a mounting space is formed along a central portion of the valve body 125 from an upper end side to a lower end side, and a drive portion that moves the valve body 125 is inserted into the mounting space 215.

The drive portion includes a piston support portion 225, a piston guide 127, a main piston 120, a back-up plate 149, a rubber piston 148, a semi-fluid 147, a diaphragm 115, wax 110, a wax case 135, and an operating heater 105, wherein the operating heater 105 is electrically connected to a connector 140.

The piston support portion 225 is formed at a central portion of the second valve (by-pass valve) 205 that is formed at a lower end portion of the valve body 125.

Figure 4:
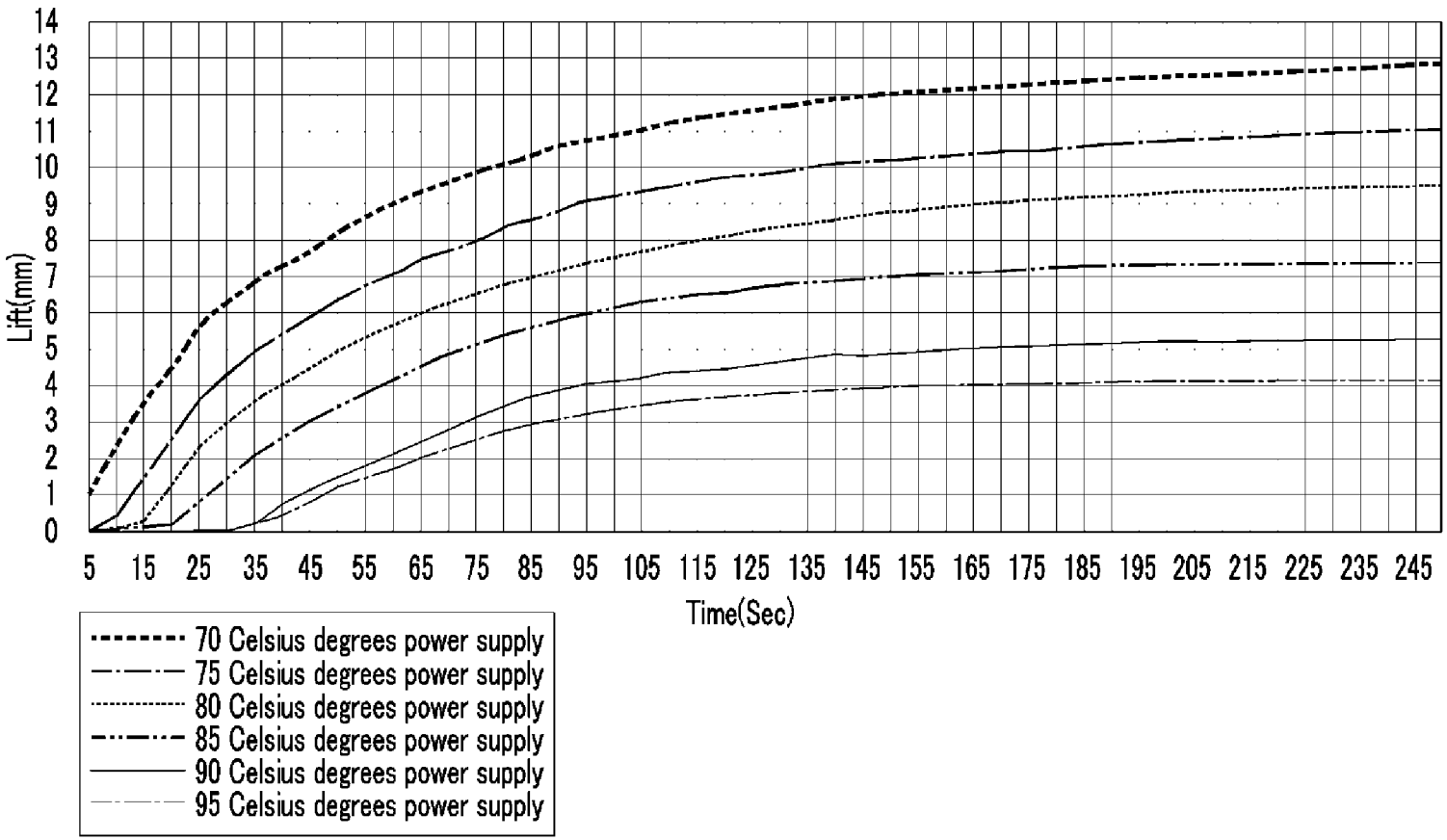
FIG. 4 is a graph showing an operational characteristic of an electrical thermostat according to an exemplary embodiment of the present invention.

FIG. 4 is a graph showing an operational characteristic of an electrical thermostat according to an exemplary embodiment of the present invention.

Referring to FIG. 4, a horizontal axis denotes an elapsed time after power is supplied to the operating heater 105, and a vertical axis denotes a height that the operating valve 200 is lifted.

More particularly, a height that the operating valve 200 is opened according to the elapsed time after a 12 voltage power is supplied to the valve 200 in a condition that a coolant temperature is Celsius 70 degrees, a height that the operating valve 200 is opened according to the elapsed time after a 12 voltage power is supplied to the valve 200 in a condition that a coolant temperature is Celsius 75 degrees, a height that the operating valve 200 is opened according to the elapsed time after a 12 voltage power is supplied to the valve 200 in a condition that a coolant temperature is Celsius 80 degrees, a height that the operating valve 200 is opened according to the elapsed time after a 12 voltage power is supplied to the valve 200 in a condition that a coolant temperature is Celsius 85 degrees, a height that the operating valve 200 is opened according to the elapsed time after a 12 voltage power is supplied to the valve 200 in a condition that a coolant temperature is Celsius 90 degrees, and a height that the operating valve 200 is opened according to the elapsed time after a 12 voltage power is supplied to the valve 200 in a condition that a coolant temperature is Celsius 95 degrees are shown on lines.

And, when the coolant temperature is 60 Celsius degrees, after it elapses 60 seconds, the operating valve 200 can be opened, when the coolant temperature is 50 Celsius degrees, after it elapses 65 seconds, the operating valve 200 can be opened, and when the coolant temperature is 40 Celsius degrees, after it elapses 70 seconds, the operating valve 200 can be opened. Also, when the coolant temperature is 30 Celsius degrees, after it elapses 75, the operating valve 200 can be opened.

As described above, when the coolant temperature is included in a heating temperature range (−40 to 40 Celsius degrees), the power that is supplied to the operating heater 105 is turned off before the operating valve 200 is moved. Accordingly, because the power is supplied to the operating heater 105 only when the operating valve 200 is closed, the coolant temperature is quickly raised.

In an exemplary embodiment of the present invention, there is a slight difference between $A \leq B$ and $A < B$. But, two above cases are applied only to understand the invention, and therefore it is understood that two above expressions contain same significance.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A control method of an electrical thermostat having an operating heater configured to heat wax so as to operate an operating valve disposed to open or close a coolant passage, comprising:

detecting a coolant temperature of coolant flowing along the coolant passage;

determining whether the coolant temperature is included in a predetermined heating temperature range, wherein the predetermined heating temperature range is set to be lower than an operating minimum temperature at which the operating valve starts to be operated only by a coolant temperature;

performing a coolant heating mode by supplying a predetermined level of power to the operating heater for a predetermined time when the coolant temperature is within the predetermined heating temperature range;

stopping the coolant heating mode before the operating valve is opened;

determining whether the coolant temperature is higher than the operating minimum temperature for operating the operating valve; and performing a valve operating control for opening the operating valve when the coolant temperature is higher than the operating minimum temperature.

2. The control method of the electrical thermostat of claim 1, further including:

selecting the predetermined level of the power and the predetermined time that are supplied to the operating heater from a map data according to the coolant temperature that is included in the predetermined heating temperature range; and supplying the operating heater with the predetermined level of the power for the predetermined time that is selected from the map data.

3. The control method of the electrical thermostat of claim 2, wherein the predetermined level of the power is a PWM duty and the PWM duty is selected from 0 to 100% range.

4. The control method of the electrical thermostat of claim 1, further including:

increasing a PWM duty when the coolant temperature is higher than a target temperature, wherein the PWM duty is the predetermined level of the power.

5. The control method of the electrical thermostat of claim 4, further including:

setting the PWM duty to 100% when an absolute value between the target temperature and the coolant temperature is determined to be larger than an upper allowance value.

6. The control method of the electrical thermostat of claim 1, further including:

decreasing a PWM duty when the coolant temperature is lower than a target temperature, wherein the PWM duty is the predetermined level of the power.

7. The control method of the electrical thermostat of claim 6, further including:

setting the PWM duty to 0% when an absolute value between the target temperature and the coolant temperature is determined to be lower than a lower allowance value.

8. A control system of an electrical thermostat that includes an operating heater configured to heat wax so as to operate an operating valve that is disposed to open or close a coolant passage, comprising:

a temperature detector that detects a coolant temperature of coolant flowing along the coolant passage;

a power supply portion that supplies the operating heater with power; and a control portion that controls the power that is supplied to the operating heater from the power supply portion by using a temperature signal that is transferred from the temperature detector, wherein the control portion determines whether the coolant temperature is within a predetermined heating temperature range, controls the power supply portion to supply the operating heater with a predetermined level of power for a predetermined time when the coolant temperature is within the predetermined heating temperature range, and stop heating the coolant using the operating heater before the operating valve is opened, wherein the heating temperature range is set to be lower than an operating minimum temperature at which the operating valve starts to be operated only by a coolant temperature, and wherein the control portion determines whether the coolant temperature is higher than the operating minimum temperature for operating the operating valve, and performs a valve operating control for opening the operating valve when the coolant temperature is higher than the operating minimum temperature.

9. The control system of the electrical thermostat of claim 8, wherein the control portion selects the predetermined level of power and the predetermined time that are supplied to the operating heater from a map data according to the coolant temperature that is included in the predetermined heating temperature range and supplies the operating heater with the predetermined level of power for the predetermined time that is selected from the map data.

10. The control system of the electrical thermostat of claim 9, wherein the predetermined level of the power is a PWM duty and the PWM duty is selected from 0 to 100% range.

11. The control system of the electrical thermostat of claim 8, wherein the control portion increases a PWM duty when the coolant temperature is higher than a target temperature, wherein the PWM duty is the predetermined level of the power.

12. The control system of the electrical thermostat of claim 11, wherein the control portion sets the PWM duty to 100% when an absolute value between the target temperature and the coolant temperature is determined to be lower than an upper allowance value.

13. The control system of the electrical thermostat of claim 11, wherein the control portion decreases a PWM duty when the coolant temperature is lower than a target temperature, wherein the PWM duty is the predetermined level of the power.

14. The control system of the electrical thermostat of claim 13, wherein the control portion sets the PWM duty to 0% when an absolute value between the target temperature and the coolant temperature is determined to be lower than a lower allowance value.

* * * * *